US009719214B1

(12) United States Patent
Greene

(10) Patent No.: US 9,719,214 B1
(45) Date of Patent: Aug. 1, 2017

(54) LIQUID ASPHALT HEATING AND MIXING SYSTEM

(71) Applicant: Maxam Equipment, Inc., Kansas City, MO (US)

(72) Inventor: Lonnie D Greene, Kansas City, MO (US)

(73) Assignee: MAXAM EQUIPMENT, INC., Kansas City, MO (US)

( * ) Notice: Subject to any disclaimer, the term of this patent is extended or adjusted under 35 U.S.C. 154(b) by 282 days.

(21) Appl. No.: 14/634,734

(22) Filed: Feb. 28, 2015

(51) Int. Cl.
*C10C 3/00* (2006.01)
*E01C 19/02* (2006.01)
*B01F 15/06* (2006.01)

(52) U.S. Cl.
CPC ..... *E01C 19/02* (2013.01); *B01F 15/063* (2013.01); *B01F 2015/062* (2013.01)

(58) Field of Classification Search
CPC ... B01F 2215/0063; C10C 3/002; E01C 19/02
USPC ..... 366/22–24, 136, 137, 147, 163.2
See application file for complete search history.

(56) References Cited

U.S. PATENT DOCUMENTS

| | | | | |
|---|---|---|---|---|
| 877,620 | A * | 1/1908 | Wells et al. | C10C 3/002 196/114 |
| 1,056,980 | A * | 3/1913 | Dundas | C10C 3/002 122/417 |
| 2,690,172 | A * | 9/1954 | Miller | C10C 3/12 126/343.5 A |
| 4,218,145 | A | 8/1980 | Brock et al. | |
| 4,863,277 | A * | 9/1989 | Neal | B01F 3/1271 366/136 |
| 5,478,147 | A | 12/1995 | O'Brien et al. | |
| 5,637,350 | A * | 6/1997 | Ross | B01F 3/0865 264/13 |
| 8,985,835 | B2 * | 3/2015 | Nasser | E01C 19/1004 366/24 |

* cited by examiner

*Primary Examiner* — David Sorkin
(74) *Attorney, Agent, or Firm* — Joseph B Bowman

(57) ABSTRACT

A liquid asphalt heating and mixing system having a double helix heat exchanger positioned within a liquid asphalt storage vessel and being connected to a fluid heater and circulator to feed hot oil through said heat exchanger for heating liquid asphalt within the storage vessel. An eductor mixer is centrally aligned longitudinally with the heat exchanger with an intake end positioned interiorly of the heat exchanger and a discharge end directed away from the heat exchanger. A liquid asphalt pump is connected to the eductor mixer and to the storage vessel to pump liquid asphalt from the storage vessel, through the eductor mixer and back to the storage vessel.

8 Claims, 7 Drawing Sheets

44
42
102
108
Hot Oil Heater and Circulator
Pump Box
2
1
40
36
34
38
30
38
22
32
24
26
28
Hot Oil Heater and Circulator
20
34
36
40

LIQUID ASPHALT HEATING AND MIXING SYSTEM

CROSS-REFERENCE TO RELATED APPLICATIONS

None

STATEMENT REGARDING FEDERALLY SPONSORED RESEARCH OR DEVELOPMENT

None

BACKGROUND OF THE INVENTION

This invention relates to equipment for asphalt production plants. More specifically, this invention relates to a system to effectively heat and mix liquid asphalt in the liquid asphalt storage tank of an asphalt production plant.

Several techniques and numerous equipment arrangements for the preparation of asphaltic compositions for road paving, also referred by the trade as "hotmix" or "HMA", are known from the prior art. Comparatively smaller quantities of such asphaltic compositions can be produced in batch plants. Alternatively, continuous production of asphalt compositions can be produced in a drum mixer asphalt plant. Typically, water laden virgin aggregates are dried and heated within a rotating, open ended drum mixer through radiant, convective and conductive heat transfer from a stream of hot gases produced by a burner flame. As the heated virgin aggregate flows through the drum mixer, it is combined with liquid asphalt and mineral binder to produce an asphaltic composition as the desired end-product. Optionally, prior to mixing the virgin aggregate and liquid asphalt, reclaimed or recycled asphalt pavement (RAP) may be added once it is crushed or ground to a suitable size. The RAP is typically mixed with the heated virgin aggregate in the drum mixer at a point prior to adding the liquid asphalt and mineral fines.

Both batch plants and continuous production, drum mixer asphalt plants include a storage tank for storing, heating and mixing liquid asphalt until this component is fed to a batcher or drum mixer in order to be incorporated into the final asphaltic composition product. Liquid asphalt must be continuously maintained above at least 300° F. in order to remain in a flowable, fluid state. Otherwise, the material will become extremely viscous, semi-solid or even solid if allowed to cool. Typical liquid asphalt tanks, therefore, include a large heating coil near the tank bottom through which is continuously circulated a heating oil to maintain the liquid asphalt at an elevated temperature in a flowable state. Such storage tanks also characteristically include a mechanical mixer with a rotatable shaft on which are mounted mixing paddles to circulate the heated liquid asphalt within the storage tank and to assist in keeping in suspension any additives that have been combined into the liquid asphalt.

Heretofore liquid asphalt storage tanks have presented several operational drawbacks. One of the chief problems is the tendency of the heating coil to "coke", or build up with oxidized oil, both internally and externally which dramatically reduces the coil's ability to transfer heat to the liquid asphalt within the storage tank. Cleaning of the coil requires emptying the tank and then entering that hazardous environment through a manway with hazmat suits and steam pressure cleaning equipment to remove the coke buildup. If cleaning is unsuccessful, then the coil must be cut out and replaced. Either process is costly, as well as potentially dangerous to maintenance personnel.

The mechanical agitator equipment is likewise costly and difficult to maintain in the presence of liquid asphalt even under normal operating conditions. In the event of unexpected cooling of the liquid asphalt to a thick viscous or semi-solid condition, added strain on mixing paddles can damage drive motors and related moving parts.

A need remains in the asphalt industry for an improved liquid asphalt heating and mixing system to effectively address the foregoing problems relating to the operation and maintenance of a liquid asphalt storage tank. The primary objective of this invention is to meet this need.

SUMMARY OF THE INVENTION

More specifically an object of the invention is to provide an improved liquid asphalt heating and mixing system that can be easily removed from the storage vessel from the outside so that cleaning and routine maintenance can be more safely carried out by personnel outside the vessel itself.

Another object of the invention is to provide an improved liquid asphalt heating and mixing system having a smaller and more efficient heating coil than the large heating coil normally associated with previously known liquid asphalt storage tanks. The reduced size of the heating coil also facilitates both interior and exterior cleaning.

An additional object of the invention is to provide an improved liquid asphalt heating and mixing system by replacing the mechanical mixing equipment normally associated with previously known liquid asphalt storage tanks with a mixer having no moving parts while still insuring adequate mixing and agitation of the material within the storage tank.

A corollary object of the invention is to provide an improved liquid asphalt heating and mixing system of the character described wherein an eductor mixer is positioned centrally within the heating coil to draw liquid asphalt through the heating coil for more effective heat transfer and to combine the heated liquid asphalt with recycled liquid asphalt to establish mixing flows within the storage vessel.

A further object of the invention is to provide an improved liquid asphalt heating and mixing system of the character described and equipped with process controls in order to minimize coking of the heating coil.

Another object of the invention is to provide an improved liquid asphalt heating and mixing system which can be easily started during upset conditions where the liquid asphalt within the storage vessel may have cooled in temperature below that desirable for fluid flow.

Yet another object of the invention is to provide an improved liquid asphalt heating and mixing system of the character described and being manufactured as a self-contained unit so as to retrofit existing liquid asphalt storage tanks.

Other and further objects of the invention, together with the features of novelty appurtenant thereto, will appear in the detailed description of the drawings.

In summary, a liquid asphalt heating and mixing system having a double helix heat exchanger positioned within a liquid asphalt storage vessel and being connected to a fluid heater and circulator to feed hot oil through said heat exchanger for heating liquid asphalt within the storage vessel. An eductor mixer is centrally aligned longitudinally with the heat exchanger coil with an intake end positioned interiorly of the heat exchanger and a discharge end directed away from the heat exchanger. A liquid asphalt pump is connected to the eductor mixer and to the storage vessel to pump liquid asphalt from the storage vessel, through the eductor mixer and back to the storage vessel.

DESCRIPTION OF THE OF THE DRAWINGS

In the following description of the drawings, in which like reference numerals are employed to indicate like parts in the various views.

DETAILED DESCRIPTION OF THE INVENTION

Figures 1, 2, 3:
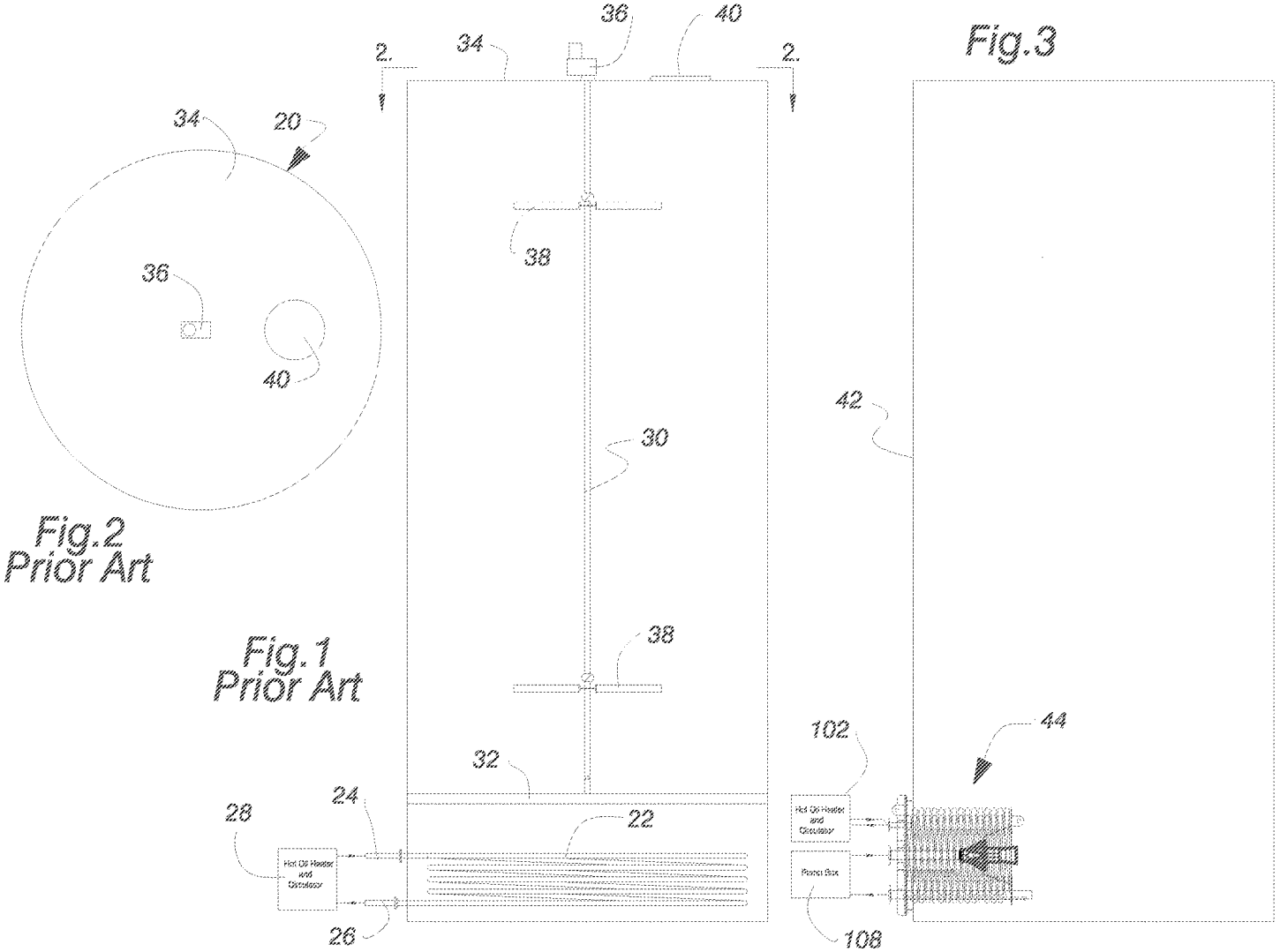
Fig.2 Prior Art
Fig.1 Prior Art
FIG. 1 is a side elevational view of a typical prior art system for heating and mixing liquid asphalt in a vertical storage tank such as found in a conventional asphalt plant.
FIG. 2 is a top plan view of the prior art system for heating and mixing liquid asphalt in a vertical storage tank as taken along line 2-2 of FIG. 1 in the direction of the arrows.
FIG. 3 is a side elevational view of a liquid asphalt vertical storage tank equipped with a heating and mixing system which is the subject of this invention.

Referring now to the drawings in greater detail, attention is first directed FIGS. 1-2 illustrating a typical prior art liquid asphalt storage tank. Shown is a vertically oriented cylindrical tank 20 with a height much greater than its diameter. Horizontally oriented squat tanks are also common but have a much larger diameter than height, or, if in the form of a cylinder supported on its side, have a much longer length than diameter. Positioned within the bottom of the tank 20 is a large coil 22 having inlet and outlet ends 24 & 26, respectively, which penetrate the side wall of tank 20 and are operatively connected to a hot oil heater and circulator 28. Typically, the coil 22 is about 1000 feet of ½ to 2" pipe.

Centrally aligned within the tank 20 is a rotatable shaft 30 supported at its lower end on a cross brace 32. The upper end of the shaft 30 extends through the top 34 of the tank 20 and is connected to a drive motor 36. Mounted along the shaft 30 are a plurality of mixing paddles 38 for stirring and agitating the liquid asphalt within the tank 20.

A manway 40 is provided in the top 34 of the tank 20 to admit maintenance personnel whenever it is necessary to clean, service, or otherwise remove the heating and mixing equipment within the tank 20. Omitted from FIG. 1 is the necessary equipment well known to those skilled in this art used to deliver the liquid asphalt from tank 20 to the batcher or drum mixer of the asphalt plant for producing a final hotmix product.

FIG. 3 illustrates a storage tank 42 of the same configuration as the tank 20 of FIGS. 1 & 2 except tank 42 is fitted with the heating and mixing system of the present system designated generally by the numeral 44. Eliminated are the requirements of a large coil 22 as well as the stirring equipment 30, 36 & 38. Omitted from FIG. 3 is the necessary equipment well known to those skilled in this art used to deliver the liquid asphalt from tank 42 to the batcher or drum mixer of an asphalt plant for producing a final hotmix product. The structural details of the heating and mixing system 44 now to be described are shown in FIGS. 4-10 and can be adapted to the vertical tank 42 illustrated or to any horizontal tank as known in the art.

A mounting flange 46 is welded to the sidewall of the tank 42 around an opening 48 in the lower region of the tank 42. The opening 48 illustrated is approximately 4'×4' square in order to accommodate the heating and mixing unit 44 when installed and to provide a manway to the interior of the tank 42 when the heating and mixing unit 44 is removed. The opening 48 can be of any convenient size and shape including a circular configuration if desired.

Figure 4:
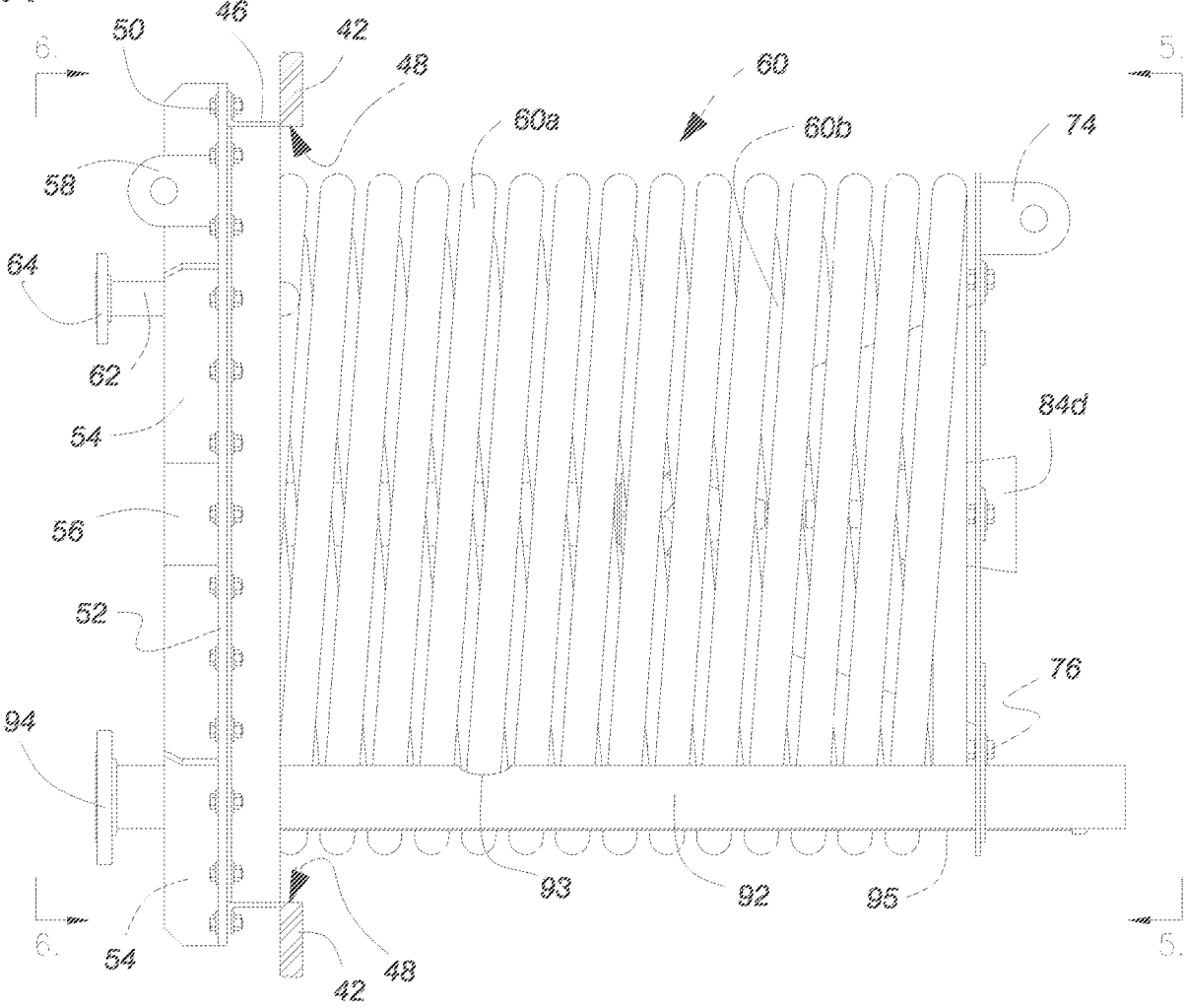
FIG. 4 is an enlarged, side elevational view of a removable heating and mixing cartridge constructed in accordance with a preferred embodiment of the invention as shown with the necessary structure for attachment to a liquid asphalt storage tank.
Figure 6:
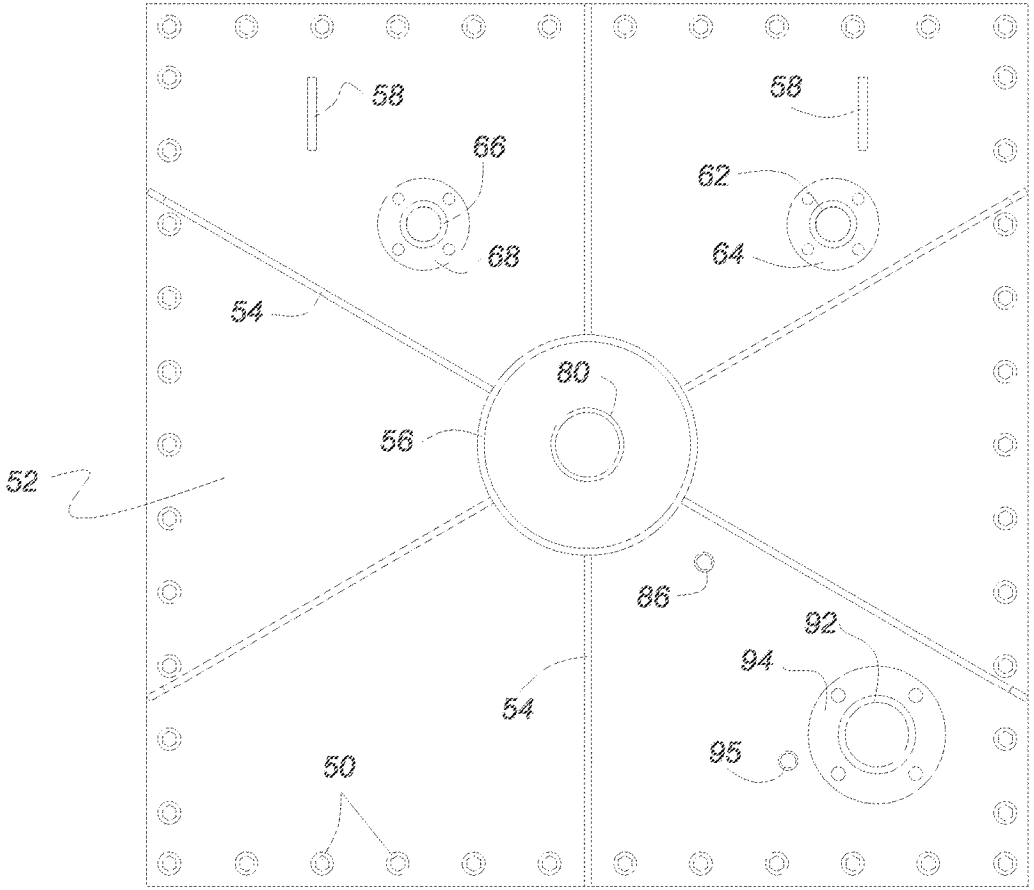
FIG. 6 is an exterior end elevational view of the removable heating and mixing cartridge shown in FIG. 4 taken along line 6-6 in the direction of the arrows.

Removably secured to the mounting flange 46 by a plurality of bolts 50 around the edge thereof is a face plate 52 covering the opening 48 through the tank 42. As best seen in FIGS. 4 & 6, the exterior side of the face plate 52 includes reinforcing stiffeners 54 radiating outwardly from a central hub 56. The face plate 52 also has lifting lugs 58 welded thereto to assist in lifting and positioning the heating and mixing unit 44.

On the interior side of the face plate 52 is secured a double helix heat exchanger 60 having outer spiral coils **60*a* encircling inner spiral coils 60*b*. The diameter of the inner spiral of the coils 60*b* defines an open cylindrical space running longitudinally through the heat exchanger 60. An inlet pipe 62 with a pipe flange 64 on the end thereof penetrates the face plate 52 to be continuous with the heat exchanger 60. An outlet pipe 66 with a pipe flange 68 on the end thereof also penetrates the face plate 52 to be continuous with the heat exchanger 60**.

As compared to large coil 22 of prior art liquid asphalt storage tank 20 which is representatively about 1000 feet of 1 to 2" pipe, the heat exchanger 60 is formed of 1½" pipe of approximately 200 feet in total length. Accordingly, the heat transfer surface required for the present invention ranges from 75% to 80% less than the corresponding heat transfer surface found in prior art storage vessels. This represents a significant equipment savings in addition to the ease of maintenance.

Although heat exchanger 60 is illustrated as a double helix, the number of coils can be increased or decreased depending upon equipment size necessary to heat the liquid asphalt. Other heat exchanger configurations, such as electric resistance heaters, can also be readily adapted for use to supply the necessary heat for maintaining the asphalt within the tank 42 in a flowable, liquid state.

Figure 5:
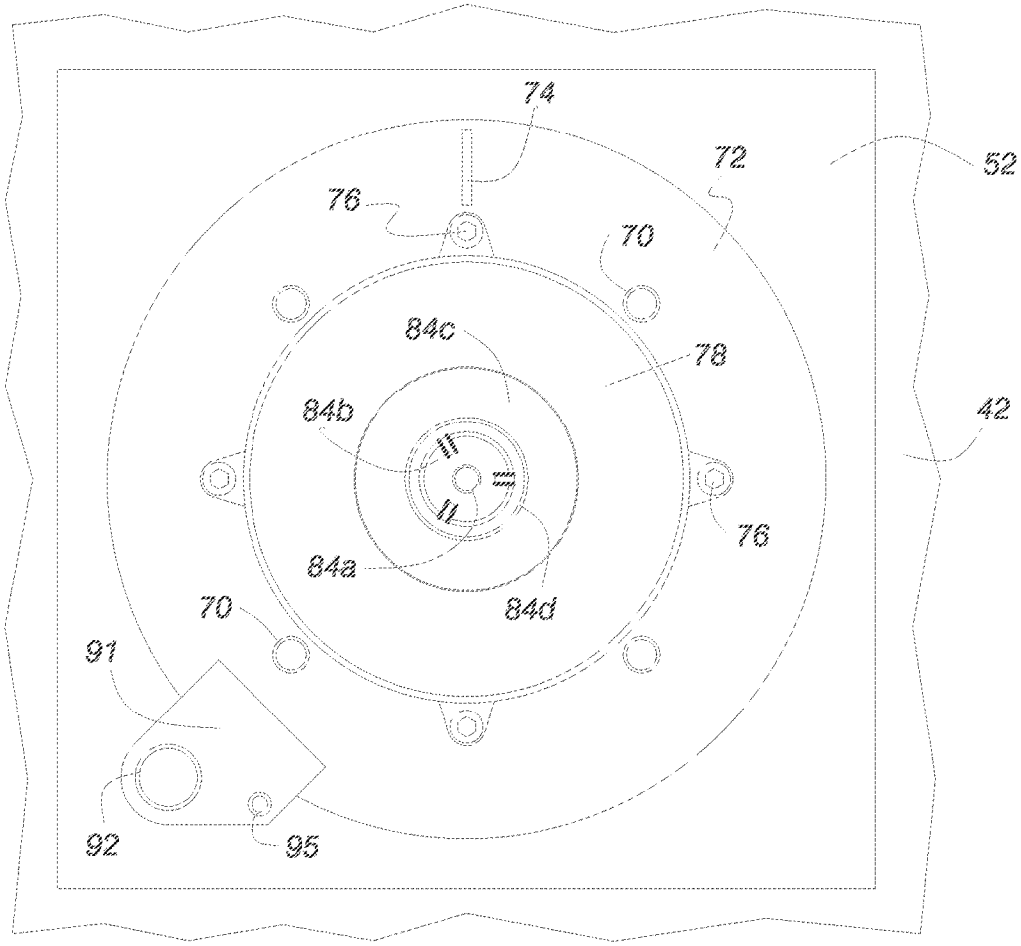
FIG. 5 is an interior end elevational view of the removable heating and mixing cartridge shown in FIG. 4 taken along line 5-5 in the direction of the arrows.
Figure 7:
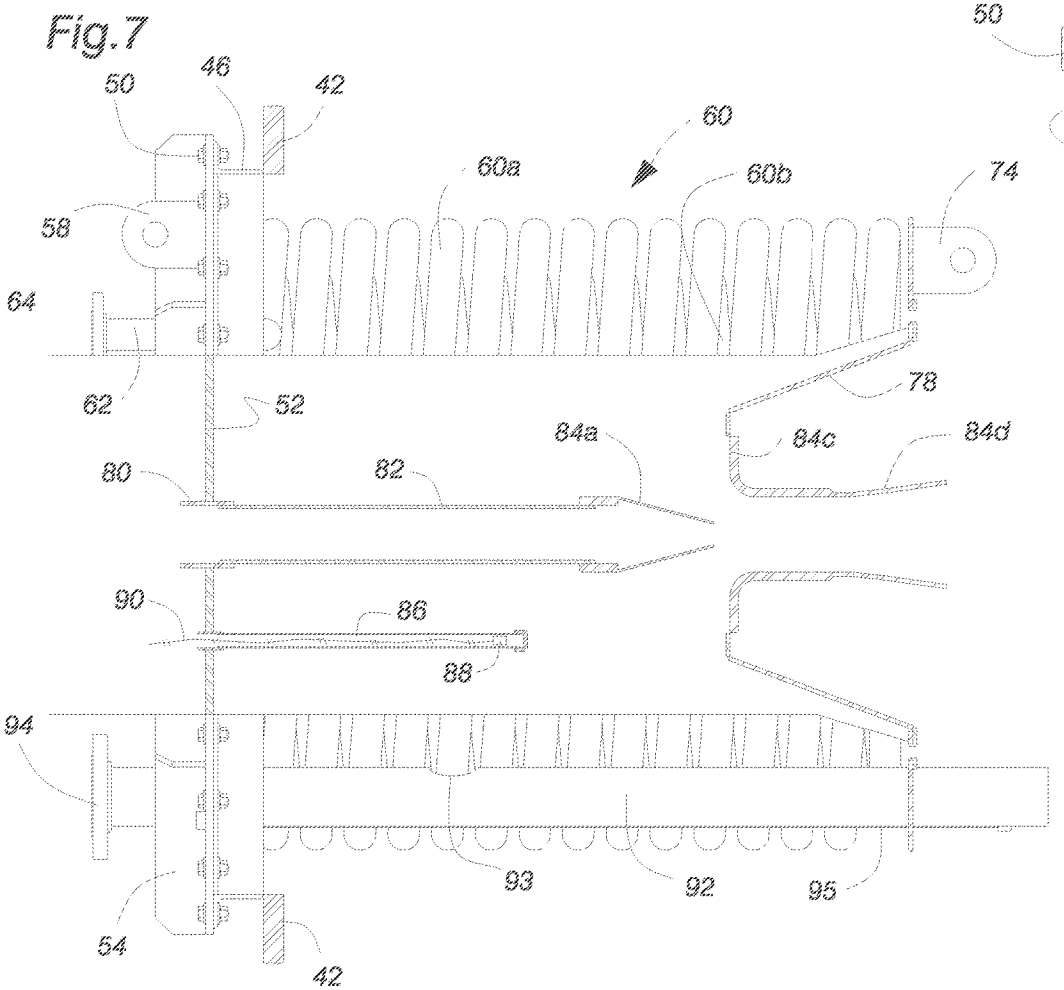
FIG. 7 is a side elevational view similar to FIG. 4 but with the heating coil broken away to show details of the mixing eductor, some process controls, and flow control baffle illustrated in section within the heating coil.

Welded to the interior side of the face plate and extending through the open cylindrical space defined by the heat exchanger 60 are four radially spaced support pipes 70. An annular ring plate 72 is welded to the inner ends of the support pipes 70 at the end of the heat exchanger 60. A lifting lug 74 is attached to the upper end of the ring plate 72. Mounted on the ring plate 72 by four radially spaced apart bolts 76 is a frusto-conical baffle 78 as seen in FIGS. 5 & 7 which extends a short distance into the open cylindrical space defined by the heat exchanger 60.

Figure 8:
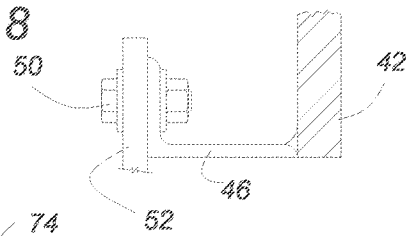
FIG. 8 is an enlarged fragmentary view illustrating the connection between the face plate of the removable heating and mixing cartridge and the mounting flange fixed to the liquid asphalt storage tank.
Figure 9:
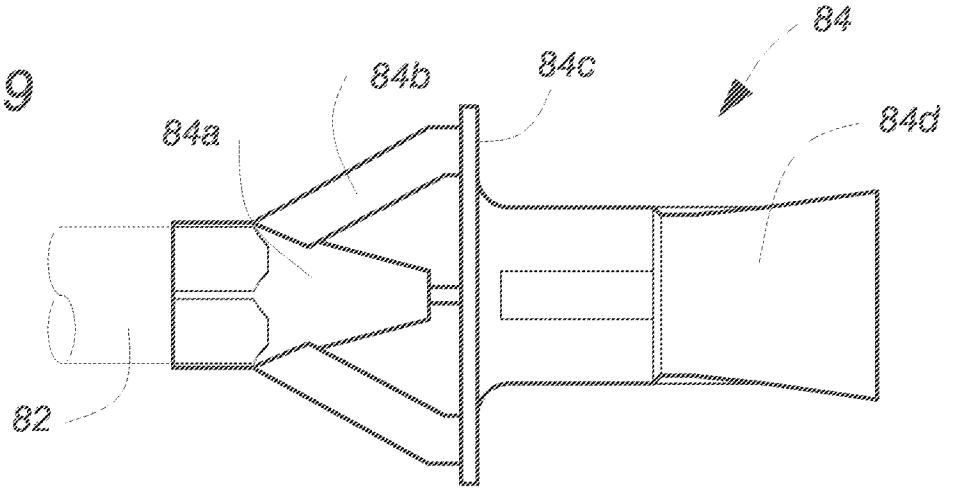
FIG. 9 is an enlarged side elevational view of the eductor mixing assembly.
Figure 10:
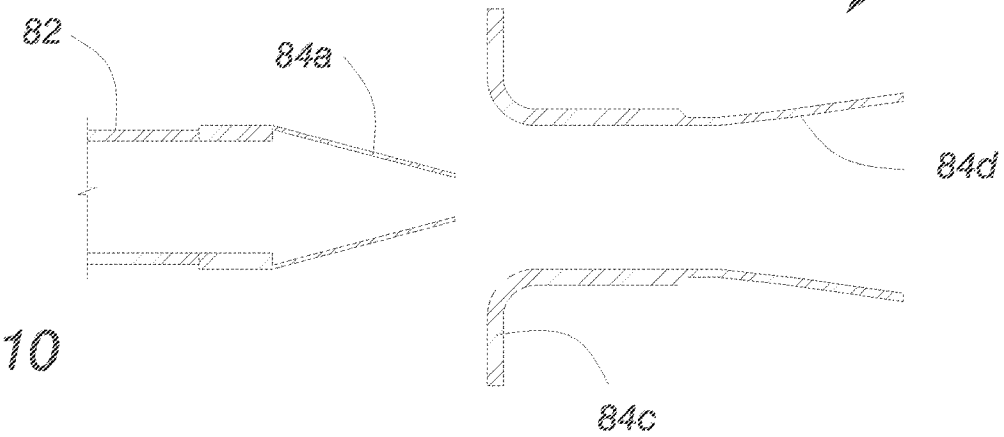
FIG. 10 is a sectional view of the eductor mixing assembly shown in FIG. 9 to better illustrate material flows.

Centrally penetrating the face plate 52 is a 3" pipe coupling 80. A delivery pipe 82 connected to the inner end of the pipe coupling 80 extends longitudinally through the cylindrical space defined by the heat exchanger 60 and has an eductor 84 mounted on the inner end thereof. The eductor 84, as best illustrated in FIGS. 8-10, includes a nozzle 84*a* held in spaced apart relationship by three support struts 84*b* from the inlet end of the eductor 84 defined by a flared ring 84*c* of a venturi section 84*d* having a discharge end outside the heat exchanger 60. The innermost opening of the frusto-conical baffle 78 is closely adjacent the flared ring 84*c* such that the inlet end of the eductor 84 lies within the heat exchanger 60 and the discharge end of the venturi section 84*d* lies outside the heat exchanger 60.

Also penetrating the face plate 52 and extending into the cylindrical space defined by the heat exchanger 60 is a temperature sensor pipe 86 for housing a thermocouple 88 with a control lead 90 for sensing the temperature of liquid asphalt within the helix coil of the heat exchanger 60.

Secured to the ring plate 72 is a bracket plate 91 extending outwardly from the outer diameter of the heat exchanger 60. The bracket plate 91 carries a 3" recycle pipe 92 that extends through the face plate 52 and terminates with a pipe flange 94. The innermost end of the recycle pipe 92 extends outwardly from the heat exchanger 60 to a position within the storage tank 42. Between the innermost end of the recycle pipe 92 and the face plate 52 is a bypass opening 93 in the length of the pipe 92 near the heat exchanger 60. The bracket plate 91 also carries a temperature sensor pipe 95 for housing a thermocouple 96 with a control lead 98 for sensing the temperature of the liquid asphalt with the storage tank 42 near the end of the recycle pipe 92.

Figure 11:
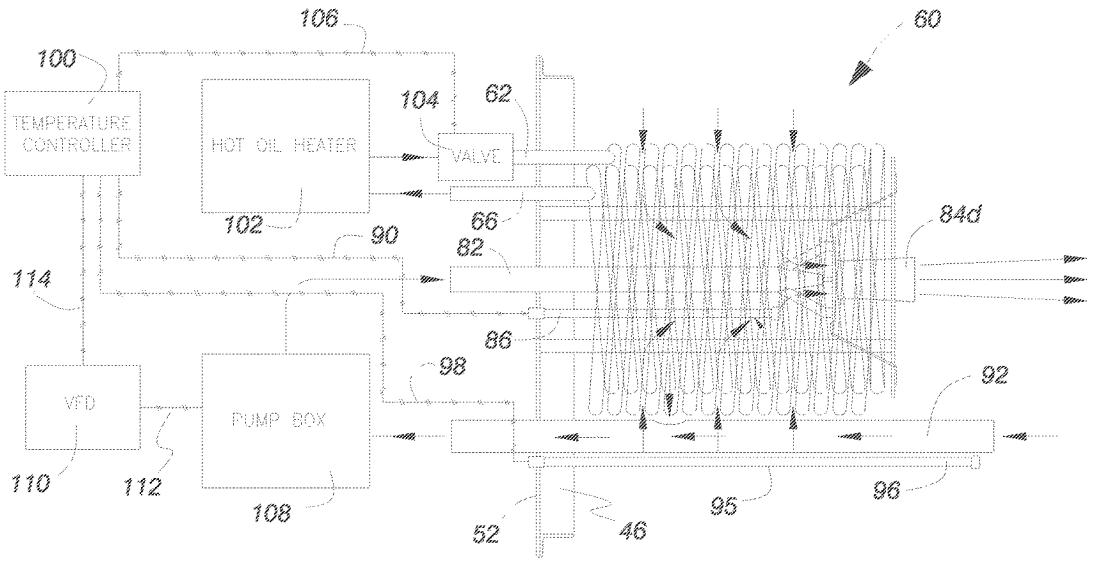
FIG. 11 is a schematic view to illustrate material flows and process controls wherein some structural features of the heating and mixing cartridge are relocated for clarity.

Auxiliary equipment and process controls for the heating and mixing system 44 are schematically illustrated in FIG. 11. Some of the structural features have been repositioned from the actual construction shown in FIGS. 4-7 for the purpose of clarity. The thermocouples 88 and 96 are connected, respectively through leads 90 & 98 to a temperature controller 100. The outlet pipe 66 from the heat exchanger 60 is connected to a hot oil heater and circulator 102 which heats the hot oil fluid from the heat exchanger 60 and returns it through a modulating valve 104 to the inlet pipe 62 of the heat exchanger 60. Details of the hot oil heater and circulator 102 are well known to those skill in the asphalt industry. The modulating valve 104 is controlled by the temperature controller 100 through a lead 106 such that if the thermocouples 88 and 96 sense that the liquid asphalt is becoming too hot, then the modulating valve 104 can be closed slightly in order to prevent coking problems. Alternatively, if the thermocouples 88 and 96 sense that the liquid asphalt is too cool, then the modulating valve 104 can be opened to provide additional heating fluid to the heat exchanger 60 for elevating the temperature of the liquid asphalt within the storage tank 44.

Connected to the liquid asphalt recycle pipe 92 is an asphalt pump 108 which returns liquid asphalt from the storage tank 44 to the pipe 82 and eductor 84. Operation of the pump 108 is influenced by a variable speed drive 110 connected through lead 112 to the pump 108 and through lead 114 back to the temperature controller 100.

Under normal operating conditions where the temperature of the liquid asphalt is in the range of 300 to 400° F., depending upon additives thereto and the grade of asphalt, liquid asphalt is withdrawn from the storage tank 44 through the recycle pipe 92 to an asphalt pump 108 which delivers the liquid asphalt back to the storage tank through the pipe 82 and the eductor 84. As the liquid asphalt passes through the nozzle 84*a* of the eductor 84, the flow velocity increases causing a loss of pressure as the material enters the venturi section 84*d*. This pressure reduction induces the flow of additional liquid asphalt from within the cylindrical space defined by the heat exchanger 60 which, in turn, draws liquid asphalt between and around the coils of the heat exchanger 60 into the cylindrical space defined by the heat exchanger 60. This action effectively creates conditions for both conductive and force convective heat transfer between the heat exchanger 60 and the liquid asphalt.

Location of the intake side of the eductor 84 between the heat exchanger 60 and the discharge of the eductor 84 away from the heat exchanger 60 insures that liquid asphalt is drawn between and around the coils of the heat exchanger 60. This action is further insured by the baffle 78 which otherwise blocks the flow of liquid asphalt material that might bypass flow around the coils of the heat exchanger 60.

Liquid asphalt is discharged through the venturi section 84*d* of the eductor 84 with sufficient force to impinge the opposite wall of the storage tank 44 and set up a mixing flow pattern of circulating liquid asphalt within the tank 44.

Under abnormal conditions as a result of cooled liquid asphalt which might be in an extremely viscous, semi-solid or solid flow condition, the heating and mixing unit 44 of this invention might be started up in the following manner. First, it would be necessary to return the asphalt within the storage tank to a flowable condition. If the asphalt will not flow so as to operate the pump 108, then heating oil is supplied to the heat exchanger 60 through the hot oil heater and circulator 102 until sufficient asphalt within the storage tank 44 around the heat exchanger 60 achieves a flowable condition such that liquid asphalt passes through the bypass opening 93 of the recycle pipe 92 to the pump 108. When this condition is achieved, then the pump 108 can be operated at a reduced capacity as determined by the variable speed drive 110 under control from the temperature controller 110 receiving input from the thermocouples 88 & 96. As flow conditions improve with escalating temperatures, then the operation of the asphalt pump 108 can be increased until such time as normal operating conditions are achieved with liquid asphalt freely flowing through the entire length of the recycle pipe 92.

Cleaning and maintenance of the heating and mixing system 44 of this invention is easily accomplished. Should coking problems exist or maintenance be otherwise indicated, the liquid asphalt in the storage tank 44 would be drawn down. When disconnected from the asphalt pump 108 and hot oil heater and circulator 102, and with the thermocouples 88 & 96 removed from pipes 86 & 95 respectively, the heating and mixing cartridge 44 can then be unbolted from the flange 46 and removed with the aid of the lifting lugs 58 from the storage tank 42. Once outside the storage tank 42, the unit 44 can be steam cleaned or otherwise maintained without the need of personnel entering the hazardous environment of the tank 44 itself.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A liquid asphalt heating and mixing system for a liquid asphalt storage vessel of an asphalt production plant, said heating and mixing system comprising:

a heat exchanger positioned within said liquid asphalt storage vessel of an asphalt production plant;

a fluid heater and circulator connected to said heat exchanger for circulating heated fluid through said heat exchanger for heating said liquid asphalt within said storage vessel;

an eductor mixer centrally positioned longitudinally in said heat exchanger, said eductor mixer having an intake end and a discharge end wherein said intake end is positioned within said heat exchanger and said discharge end is directed outwardly from said heat exchanger;

a liquid asphalt pump connected to said eductor mixer and to said storage vessel to pump liquid asphalt from said storage vessel back to said eductor mixer;

whereby said liquid asphalt pumped through said eductor mixer induces liquid asphalt within said storage vessel to flow around said heat exchanger which transfers heat from the circulating heated fluid therein to the liquid asphalt as it is drawn into said intake end of the eductor mixer and discharged through said discharge end of the eductor mixer for mixing the liquid asphalt within the storage vessel.

2. The liquid asphalt heating and mixing system as in claim 1, said heat exchange formed as a helix defining an open, central cylindrical interior space with a diameter D, and said eductor mixer aligned substantially coincident with the longitudinal axis of said central cylindrical interior space of said heat exchanger.

3. The liquid asphalt heating and mixing system as in claim 1 wherein said storage vessel includes a flanged opening to the interior of said vessel and said liquid asphalt heating and mixing system further includes a mounting plate on which is supportingly attached said heat exchanger coil and said eductor mixer, said mounting plate being removably connected to and covering said flanged opening of said storage vessel.

4. The liquid asphalt heating and mixing system as in claim 1 including a baffle positioned and arranged between said heat exchanger and said eductor mixer to form a fluid flow barrier between said intake end and said discharge end of said eductor mixer whereby liquid asphalt within said storage vessel induced to flow around said heat exchanger is directed to said intake end of the eductor mixer and discharged through said discharge end of the eductor mixer for mixing the liquid asphalt within the storage vessel.

5. The liquid asphalt heating and mixing system as in claim 1 including a liquid asphalt recycle pipe having an intake end positioned within said storage vessel remote from said heat exchanger and being connected to said liquid asphalt pump to pump liquid asphalt from said storage vessel back to said eductor mixer.

6. The liquid asphalt heating and mixing system as in claim 5, said recycle pipe also including an opening adjacent said heat exchanger to receive asphalt liquefied near said heat exchanger during start-up conditions to pump said liquid asphalt from said storage vessel back to said eductor mixer.

7. The liquid asphalt heating and mixing system as in claim 1 including a temperature process controller, a first thermocouple sensor positioned within said heat exchanger for sensing temperature of said liquid asphalt in said region, a second thermocouple sensor positioned outside and adjacent said heat exchanger for sensing temperature of said liquid asphalt in said region, and a variable speed drive controller connected to said temperature process controller and said liquid asphalt pump to regulate the pump rate of liquid asphalt from said storage vessel back to said eductor mixer.

8. The liquid asphalt heating and mixing system as in claim 1 including a temperature process controller, a first thermocouple sensor positioned within said heat exchanger for sensing temperature of said liquid asphalt in said region, a second thermocouple sensor positioned outside and adjacent said heat exchanger for sensing temperature of said liquid asphalt in said region, and a modulating valve connected to said temperature process controller and to said fluid heater and circulator to regulate the flow of circulating heated fluid through said heat exchanger for heating said liquid asphalt within said storage vessel.

* * * * *